US006161553A

United States Patent [19]

Lytle

[11] Patent Number: 6,161,553

[45] Date of Patent: Dec. 19, 2000

[54] HAIR CURLING METHOD AND EQUIPMENT

[76] Inventor: Judy Lytle, 905 Ashland Ave., Glenolden, Pa. 19036

[21] Appl. No.: 09/401,737

[22] Filed: Sep. 23, 1999

[51] Int. Cl.[7] ..... A45D 7/00; A45D 2/00; A45D 2/12

[52] U.S. Cl. ..... 132/210; 132/222; 132/226

[58] Field of Search ..... 132/210, 222, 132/221, 223, 226, 245, 246, 247, 250, 203, 207

[56] References Cited

U.S. PATENT DOCUMENTS

| | | | |
|---|---|---|---|
| 1,654,775 | 1/1928 | Bailey | 132/222 |
| 1,656,136 | 1/1928 | Boecklen | 132/210 |
| 1,657,029 | 1/1928 | Nicosia | 132/222 |
| 1,659,490 | 2/1928 | Kunin | 132/210 |
| 1,674,068 | 6/1928 | Schnell | 132/222 |
| 1,719,555 | 7/1929 | Lewis et al. | 132/222 |
| 1,734,961 | 11/1929 | Brown | 132/210 |
| 1,806,008 | 5/1931 | Watts | 132/210 |
| 1,893,352 | 1/1933 | Backman | 132/222 |
| 1,994,099 | 3/1935 | Fulton | 132/207 |
| 2,018,127 | 10/1935 | Hauser | 132/222 |
| 2,725,060 | 11/1955 | Pazul | 132/220 |
| 4,892,110 | 1/1990 | Harvie | 132/273 |
| 5,411,040 | 5/1995 | Forrest | 132/211 |
| 5,829,455 | 11/1998 | Bauer | 132/222 |
| 6,041,791 | 3/2000 | Belmonte et al. | 132/222 |

*Primary Examiner*—John J. Wilson
*Assistant Examiner*—Robyn Kieu Doan
*Attorney, Agent, or Firm*—Elman & Associates

[57] ABSTRACT

Long hair is curled by isolating each of the strands of hair that the subject desires to be curled; applying a curling agent to the strand at this point or later; placing a curling ribbon comprising a ribbon of fabric having three longitudinal stiffening wires adjacent the strand of hair and wrapping it around the strand to envelop the hair strand; securing the curling ribbon to the base of the strand; and then winding the ribbon-enveloped strand around a cylindrical curling mandrel. The mandrel is then withdrawn from within the coil without uncoiling the strand, and the process is repeated until all of the coils are made. After the setting or permanent waving agent has worked, the stiffened ribbon is removed and the hair is combed out. Alternatively, the ribbons may be allowed to remain in the hair as decoration. The curling ribbon may be secured to the strand of hair by a base stiffener in the curling ribbon, or by a twist-tie, or by a spring-loaded clip, or by a comb provided at the base of the curling ribbon, preferably a locking comb of flexible metal.

22 Claims, 5 Drawing Sheets

HAIR CURLING METHOD AND EQUIPMENT

FIELD OF THE INVENTION

The present invention relates to hair curling, providing novel improvements in technique and equipment for curling hair using setting lotion or permanent waving solution.

BACKGROUND OF THE INVENTION

Since time immemorial, women have sought to look as beautiful as possible. Long, curly hair complements a pleasing face and gives an overall impression of femininity. Those who are genetically endowed with straight hair have used techniques to make their hair wavy or curly, generally by arranging their hair around curlers or a curling iron and applying a chemical composition or heat.

Legend has it that as a child, Shirley Temple's famous curly strands were set using ribbons in some way. Searching for patents related to my invention, we found U.S. Pat. No. 1,654,775 to Bailey. Although Bailey shows a ribbon with wires along each edge for use in conjunction with a curling iron, it does not show the curling ribbon I find preferable, nor does it suggest the improved method of curling hair that I have discovered.

SUMMARY OF THE INVENTION

The present invention provides a method for curling hair comprising the following steps:

Isolating a strand of hair that the subject desires to be curled;

Providing a curling ribbon comprising a ribbon of fabric having a plurality of bendable stiffening elements extending longitudinally thereof;

Placing the curling ribbon adjacent the strand of hair and wrapping it around the strand to envelop substantially the entire hair strand;

Securing the curling ribbon to hair at or near the base of the strand;

Providing a curling mandrel of generally cylindrical shape having a diameter the size of the desired curls, and placing it adjacent the base of the hair strand to which the curling ribbon has been secured;

Wrapping the curling ribbon helically around the curling mandrel until substantially the entire strand of hair is coiled around the curling mandrel within the curling ribbon;

Withdrawing the curling mandrel axially from within the coil without uncoiling the strand;

Applying a curling agent to the strand; and

Permitting the strand to remain coiled within the curling ribbon until the curling agent has curled the strand of hair.

The curling agent may be a setting composition or a permanent waving composition. If it is a setting composition, it may be applied at any time. If it is a permanent waving composition, it is preferably applied after the curling mandrel has been withdrawn.

The curling ribbon may be secured to the strand of hair by a base stiffener in the curling ribbon, or by a twist-tie, or by a spring-loaded clip, or by a comb provided at the base of the curling ribbon, preferably a locking comb of flexible metal.

Optionally the subject may keep some or all of the curling ribbons on her hair for decoration even after the curling agent has done its job; however usually the method is completed by removing the curling ribbon from around the strand and unsecuring it from the strand, so that the curled hair strand may be combed out.

Of course, the present method is desirably applied to more than the one strand of hair, and so more generally a user would perform the following steps:

Isolating additional strands of hair on the subject's head;

Providing an additional curling ribbon for applying to each of the additional strands of hair;

Placing one of the additional curling ribbons adjacent to each of the additional strands of hair and wrapping it around the strand to envelop substantially the entire hair strand;

Securing the additional curling ribbon to hair at or near the base of the strand;

Placing the curling mandrel adjacent the base of each of the additional hair strands to which one of the additional curling ribbons has been secured;

Wrapping the curling ribbon helically around the curling mandrel until substantially the entire strand of hair is coiled around the curling mandrel within the curling ribbon;

Withdrawing the curling mandrel axially from within the coil without uncoiling the strand;

Applying curling agent to the strand; and

Permitting each of the additional strands of hair to remain coiled within each of the additional curling ribbons until the curling agent has curled the strands of hair.

In my invention, the ribbon of fabric is between about 5 and 7 centimeters wide. It is also between about 40 and 75 centimeters long. The fabric may be brightly colored or decorated with images.

You apply the method described above to many hair strands in a single session, usually the entire head of the subject's hair, and so you need to provide a separate curling ribbon for each hair strand. However, you only need to use a single curling mandrel, since you're done using it with the first strand before you start on the second strand, and so forth.

Preferably the curling mandrel is a cylinder that can have its diameter reduced by squeezing it, so that it can be easily withdrawn from each coiled strand of hair. Desirably, two or more curling mandrels of different diameters can be provided in a set, or as part of a kit, allowing the user to select a mandrel that provides curls of the tightness or looseness desired by the subject.

The curling agent may be a conventional setting composition or a more stringent permanent setting composition. Generally it is desirable to blow dry the hair while the strands of hair are coiled within the curling ribbons. The hair may be dried with air at room temperature or with warm air, as desired.

The curling ribbon may be secured to the strand of hair by a separate clip, such as a spring-loaded hair clip, preferably having a pair of generally concave jaws with teeth facing each other. Alternatively each of the curling ribbons may be fashioned to include its own comb at one end, the teeth of which would engage the base of the hair strand. Such curling ribbons are also an invention.

I have found it preferable to include in the curling ribbon an additional stiffening element extending parallel to the edges down the middle. This invention includes curling ribbons comprising:

A ribbon of fabric having a base end and a distal end;

A pair of edge stiffeners extending longitudinally along each edge; and

A longitudinal stiffener extending parallel to the edge stiffeners between them.

Optionally the curling ribbons may be colored or decorated in an attractive way. The subject may optionally choose to leave some or all of the ribbons in her hair as a fashionable hair decoration, even after the curls are set.

It is desirable to provide a kit for use in performing the method of the present invention, comprising at least 20 curling ribbons, a first curling mandrel, and instructions. Preferably the kit contains at least one additional curling mandrel having a different diameter from the first curling mandrel. Optionally the kit also includes a curling agent. Such a kit is also an invention.

An advantage of this invention is that it can be used in a variety of curling and decorating applications, such as with human hair, animal hair or synthetic hair as well as with implanted hair and with all manner of wigs and hair replacements in which the hair is not or may not be attached to the subject. These and other features and advantages of the present invention will become apparent from a reading of the following detailed specification, taken in conjunction with the enclosed drawings.

DESCRIPTION OF THE PREFERRED EMBODIMENTS

By "subject hair," I mean the hair that is being curled in accordance with my invention. By subject, I mean a person whose hair may be curled in accordance with my invention. By "user," I mean the person who is curling the subjects hair by applying a curling ribbon to strands of the subject hair according to the method I describe here. The user may be a beautician, a friend, or the subject (herself or himself).

The curling agent may be any conventional composition for hair setting or permanent waving ("perm"). For example, a conventional setting lotion is "Perfect Combout" by Zotos. A conventional perm composition is "Feel So Lively" by Zotos. In carrying out the present invention, first the user typically washes and towel dries the subject hair, and may lightly air dry or blow dry it as well. Then or later in the process, a curling agent is applied to the hair, preferably when the hair is dry. I prefer curling agents that are applied as a mousse or glaze. A conventional perm composition is preferably applied after all of the curling ribbons have been secured into place.

The user then isolates each of about 36 to 40 strands of hair to be curled, each from an area of the subject's scalp approximately 1½ inches by ½ inch (40 mm by 15 mm). It is good practice, but optional, if the user first parts the hair into quadrants and temporarily pins the hair from three of the quadrants up out of the way. The user then starts isolating the hair strands at the bottom of the head near the back and works one's way up the head to the top, proceeding around the head quadrant by quadrant.

Figure 1:
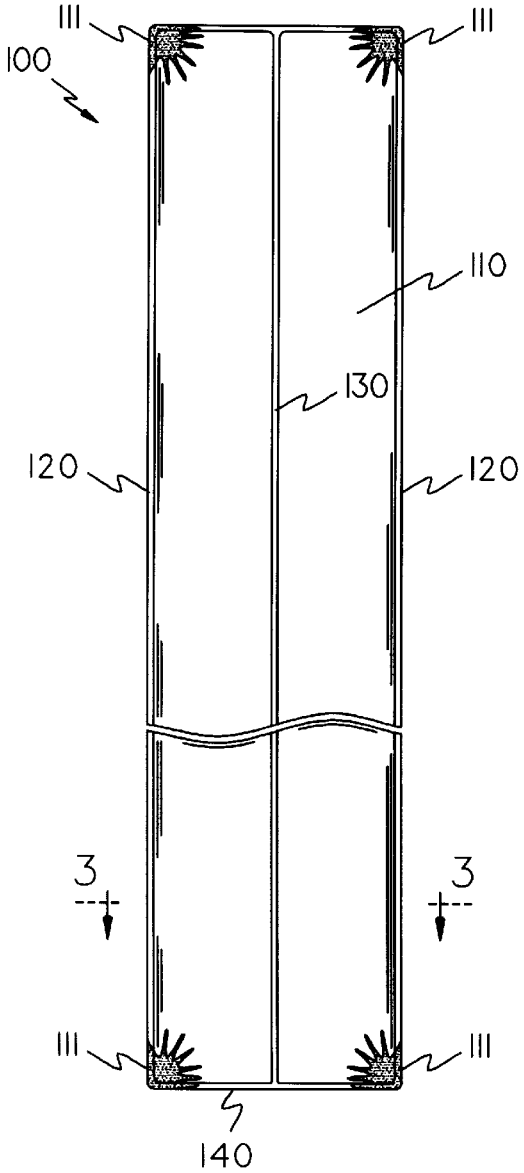
FIG. 1 is a plan view of an embodiment of a curling ribbon of the present invention.
Figure 3:
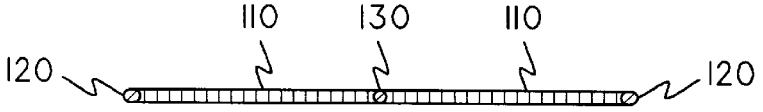
FIG. 3 is a cross-sectional view of the curling ribbon of FIG. 1 taken along the line 3—3.

FIGS. 1 and 3 show an example of a curling ribbon 100 of my invention. It comprises a long, narrow length of fabric 110. The width should be sufficient to extend around and lap over a strand of hair from the subject's head and long enough to cover substantially the entire length of the subject's hair. Preferably the fabric is 5 to 7 cm wide and 40 to 75 cm long. Most preferably it is 6 cm wide.

In the accompanying figures, the fact that this element is fabric is represented by conventional drawing symbols, such as the symbols 111. Desirably the fabric is loosely woven to allow air to flow through it to facilitate drying, but it should not be an open mesh, which would not provide enough support to the strands of hair. It may be polyester, chiffon or nylon, for example. Using a more tightly woven fabric will result in smaller, tighter curls; using a more loosely woven fabric will result in bigger, looser curls. Desirably it is brightly colored or printed with a decorative design. I have found that subjects sometimes wish to keep some or all of the curling ribbons in their hair for awhile as a decoration.

Along each edge of the ribbon 100 is an edge stiffening element 120 of bendable material that remains in place to support the hair after being bent to shape. Desirably the stiffening element is metal wire. Plastic-coated copper wire of 18 to 22 gauge is preferred. If the curling agent is setting lotion, the wire need not be coated, but for use with "perm" compositions, which tend to corrode copper, the wire should be coated or else made of stainless steel or other resistant substance.

The wire may be secured to the selvedge of the fabric 110 by sewing the edge of the fabric to itself, or alternatively by weaving the wire through the edge of the fabric, or by adhesive.

Along one of the narrower edges of the ribbon 100 is a base stiffener 140 of bendable material such as the material of the edge stiffeners 120, similarly secured to the edge of the fabric 110. The base stiffener 140 of this embodiment serves to hold the base of the curling ribbon 100 in position when it is folded around a strand of hair.

A central stiffener 130 extends parallel to the edge stiffeners longitudinally within the fabric 110, preferably along the center of the curling ribbon 100. It is also of bendable material such as the material of the edge stiffeners 120. It may be sewed to the fabric, or woven through the fabric, or secured by adhesive.

Figure 2:
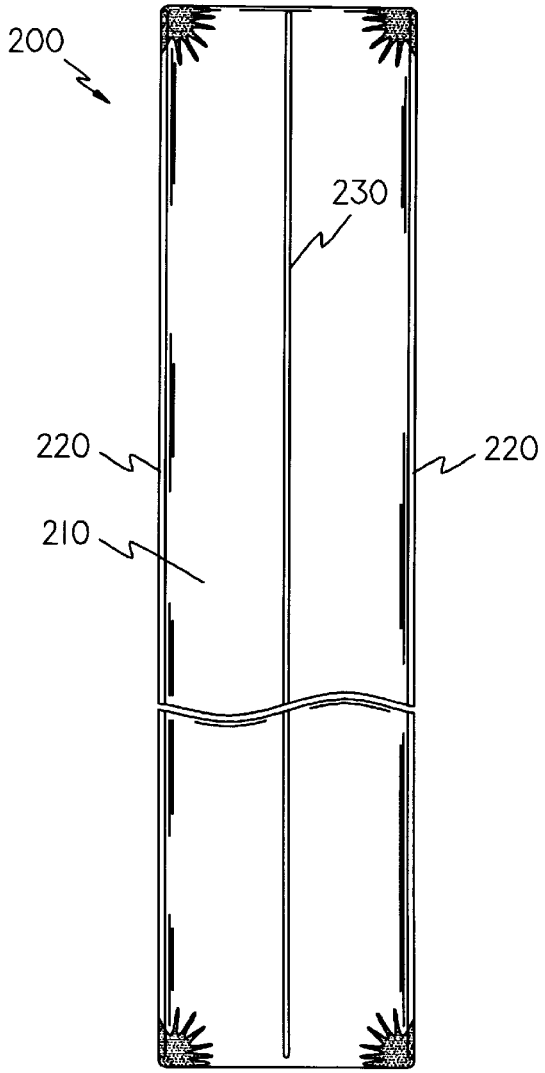
FIG. 2 is a plan view of an alternative embodiment of a curling ribbon of the present invention.
Figure 5:
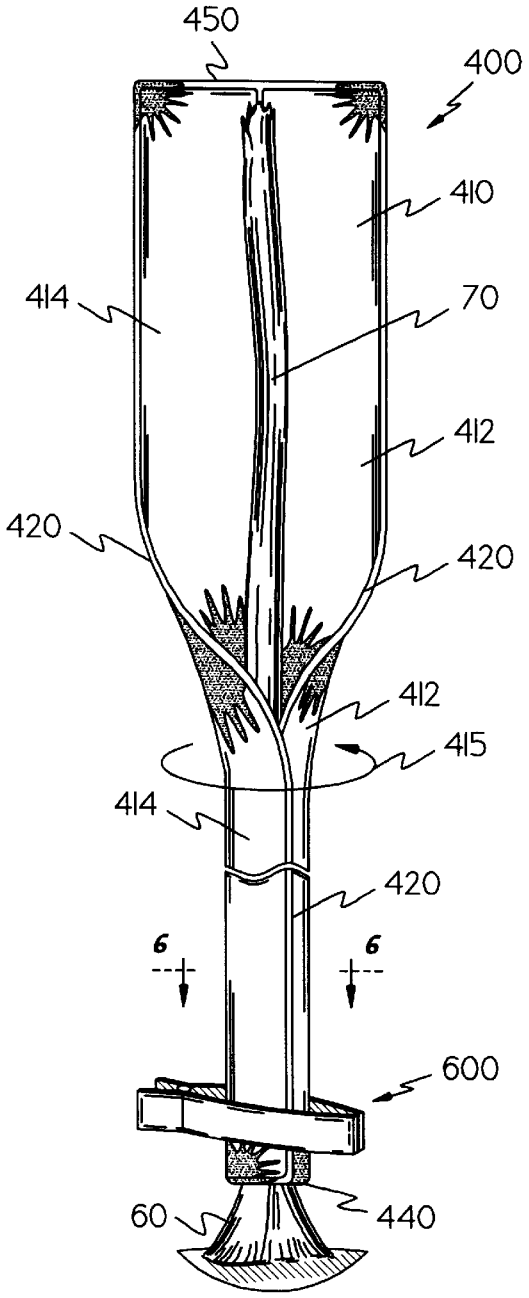
FIG. 5 is a view similar to FIG. 4, wherein the lower portion of the curling ribbon has been wrapped around the strand of hair, and a clip has been applied near the scalp to secure the curling ribbon.
Figure 6:
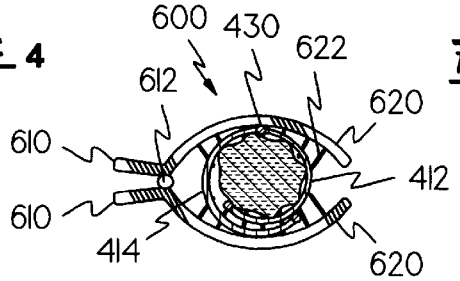
FIG. 6 is a cross-sectional view of the strand of hair, curling ribbon and clip of FIG. 5 taken along the line 6—6.

FIG. 2 shows an alternative curling ribbon 200. It is similar to the curling ribbon 100 in that it has edge stiffeners 220 and a central stiffener 230 which correspond to elements 120 and 130 described above. However, in curling ribbon 200 an element corresponding to the base stiffener 140 is omitted. Instead it needs to be secured to a strand of hair by a clip 600 such as shown in FIGS. 5 and 6.

An alternative to the clip 600 is to use conventional plastic-covered twist-ties (not shown) to secure a curling ribbon to the base of a strand 70 of the subject's hair.

FIGS. 4 through 10 show yet another embodiment of the curling ribbon 400. Like curling ribbon 100, curling ribbon 400 has a pair of edge stiffeners 420, a central stiffener 430, and a base stiffener 440. However it also has an end stiffener 450 constructed like the base stiffener 440. This provides additional support for the distal end of the curling ribbon 400 (the end farthest away from the base of the hair).

Figure 4:
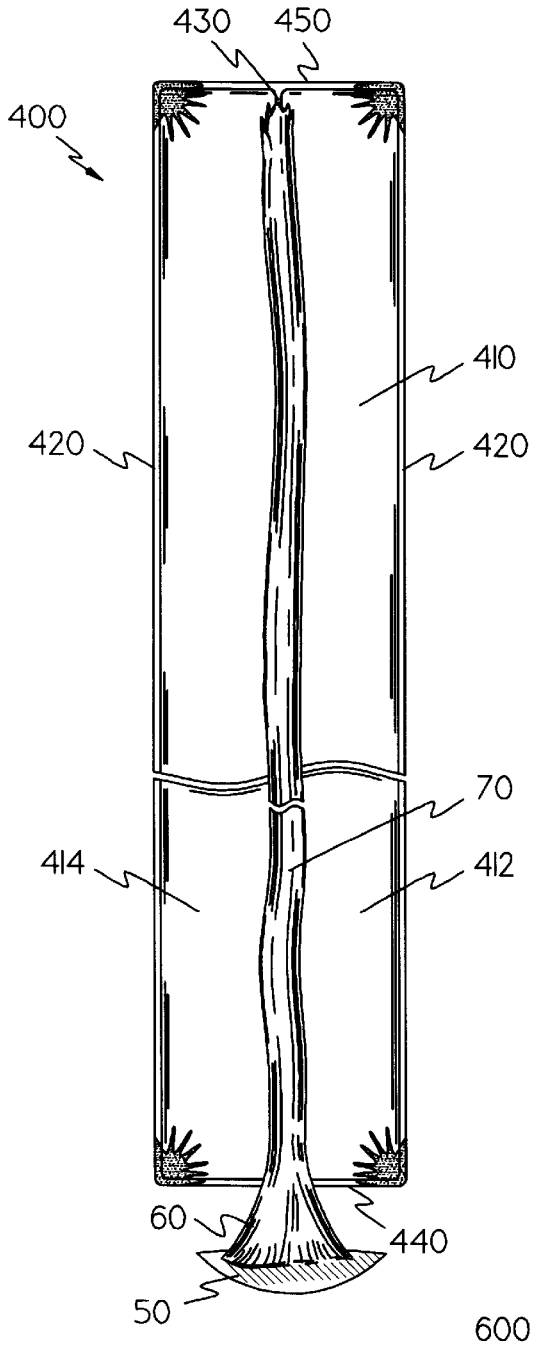
FIG. 4 shows a strand of hair extending upwards from a subject's scalp, having yet another embodiment of a curling ribbon of the present invention adjacent thereto.

As shown in FIG. 4, curling ribbon 400 is used by placing it adjacent to a strand 70 of the user's hair. The base stiffener 440 is placed close to the scalp 50 and the base 60 of the strand of hair, and the strand 70 is placed alongside the curling ribbon 400 near the longitudinal stiffener 430. The curling ribbon 400 is preferably at least as long as the strand 70 of the subject's hair. Typically the user starts by isolating a strand near the base of the subject's scalp and then when that strand has been secured, enclosed and wound in a curling ribbon, the user provides another curling ribbon and isolates another strand of hair, generally proceeding up the scalp quadrant by quadrant. If a conventional setting lotion is used, it may be applied before, during or after winding the strand and securing the curling ribbon to it. Preferably a setting lotion is applied before winding a strand and securing the curling ribbon to it. If a conventional "perm" solution is used, it should be applied in accordance with the directions accompanying the "perm" solution packaging, and preferably after all the hair to be curled has been secured and wound in curling ribbons and while the hair is wet.

As shown in FIG. 5 the strand 70 is enveloped by the curling ribbon 400. In this illustration, first a part of the right hand side 412 of the curling ribbon 400 is wrapped or folded around the lower portion of the strand 70, starting from the hair base 60 and working away from the scalp 50. Then a part of the left hand side 414 of the curling ribbon 400 is wrapped (in the direction shown by arrow 415) around the lower portion of the right hand side 412 of the curling ribbon 400 that already envelopes the hair strand 70.

These movements serve to wrap the base stiffener 440 around the base of the hair strand 70. In some embodiments of the invention, the base stiffener 440 is sturdy enough to secure the curling ribbon 400 without further assistance. However, as shown in FIGS. 5 and 6, it is preferred to secure the curling ribbon 400 near the base of the hair strand 70 by means of a clip 600.

As shown, the clip 600 has a spring-loaded pivot 612 and a pair of arms 620 which may be opened by squeezing together a pair of flanges 610. The arms 620 desirably have teeth 622 extending therefrom which bite through the fabric 410 into the strand 70 of hair to secure the base end of the curling ribbon 400 to the strand 70 of hair.

Proceeding from the configuration of FIG. 5, the user successively folds more of the right hand side 412 around the strand of hair 70 and then folds more of the left hand side 414 around the enfolded right hand side 412 to enclose the strand of hair completely within the curling ribbon 400.

Figure 10:
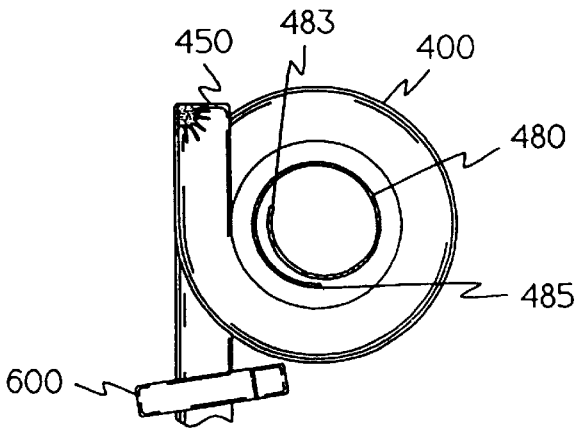
FIG. 10 is a sectional view of FIG. 9 taken along the line 10—10.
Figure 11:
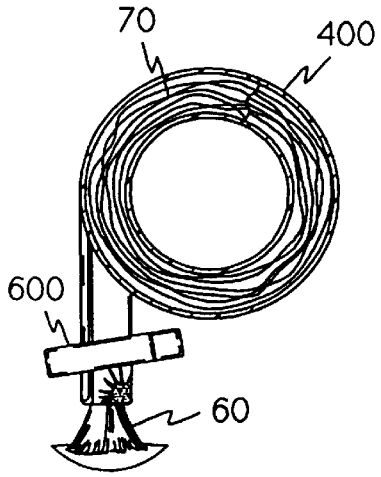
FIG. 11 is a sectional view of FIG. 9 taken along the line 11—11.

A generally cylindrical curling mandrel 480 is then provided. The mandrel 480 is chosen to have the same diameter as the curls desired by the subject, for example about 1 to 3 cm. The curling mandrel 480 may be a hollow plastic cylinder having a longitudinal slit that permits the ends 483, 485 to overlap when the curling mandrel 480 is squeezed as shown in FIG. 10. Alternatively it may be a solid rod that is smooth enough to be withdrawn from within the coil, as described below. The curling mandrel should be long enough to accommodate coiling the entire strand of hair around it and to allow the user to maintain a grip on one end of it before the curling mandrel is withdrawn from the curled hair.

Figure 7:
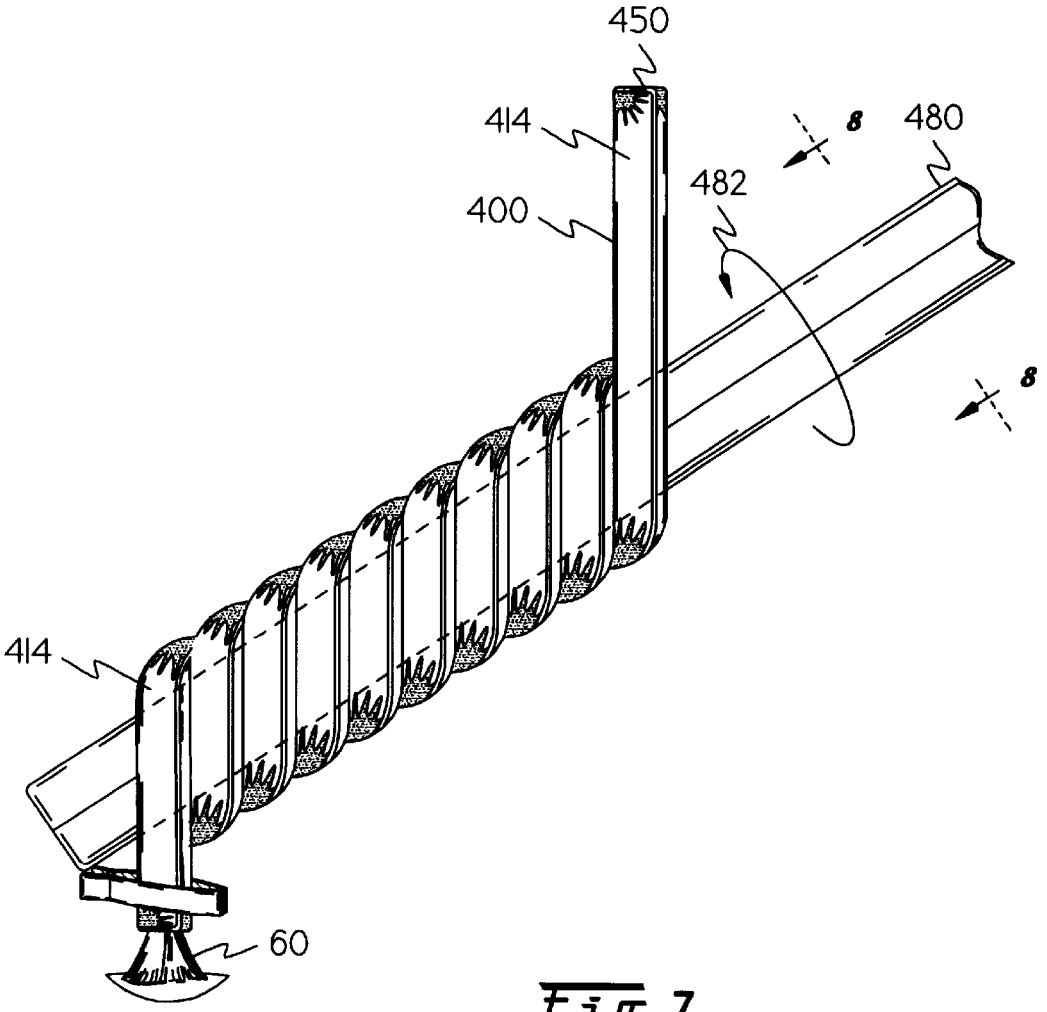
FIG. 7 is a view similar to FIG. 5, wherein the entire curling ribbon has been wrapped around the strand of hair, and then wound helically around a curling mandrel.

Starting from the base 60 of the hair strand 70, the curling ribbon 400 (containing the hair strand 70 enveloped within) is helically coiled around the curling mandrel 480, as shown in FIG. 7. The direction in which the curling ribbon 400 is coiled around the curling mandrel 480, clockwise or counterclockwise, may depend on the position of the particular strand in the style desired by the subject.

The distal end of the curling ribbon 400 extending to the end stiffener 450 is successively wrapped around the curling mandrel 480 in the direction shown by arrow 482 until the entire curling ribbon 400 is helically coiled. See FIG. 9.

Figure 9:
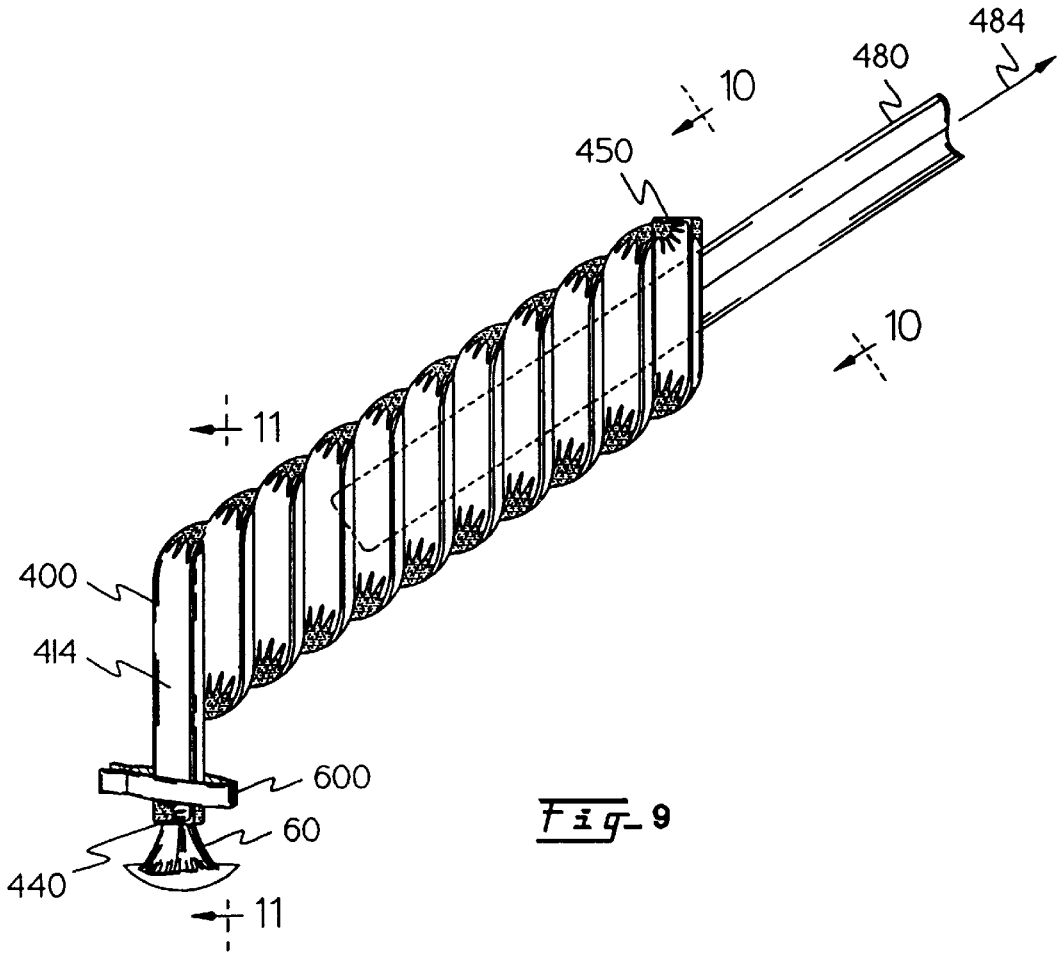
FIG. 9 is a view similar to FIG. 7, wherein the curling mandrel has been compressed and partially withdrawn from the coiled strand of hair.

When the entire ribbon 400 is coiled, the user squeezes the curling mandrel 480 and causes its longitudinal edges 483 and 485 to overlap. This squeezing action reduces the diameter of the curling mandrel 480, permitting its easy withdrawal in the axial direction shown by arrow 484. FIG. 9 shows the curling mandrel 480 as it is being withdrawn. If a non-compressible curling mandrel is used, it is of course withdrawn without changing its diameter.

When the curling mandrel 480 has been fully withdrawn, the hair strand 70 is helically coiled within the curling ribbon 400. You recall that the edge stiffeners 420 and longitudinal stiffener 430 have been bent into shape as the curling ribbon 400 was being coiled around the curling mandrel, and now they serve to hold the fabric 410 in place, enveloping the curled strand of hair 70 in the curling ribbon 400 without any other support being needed. Alternatively, if the user finds it desirable as a means to create a particular hair style, the curls may be pinned into place or otherwise secured by additional means while the hair is dried and set.

The process is then performed successively on other strands of the subject's hair, by providing additional curling ribbons, a total of forty curling ribbons being typical for the usual full head of hair. The curling mandrel 480 may be used again and again. Optionally, a different curling mandrel of a different diameter may be used as desired to style other strands of hair with a tighter or looser curl.

Figure 12:
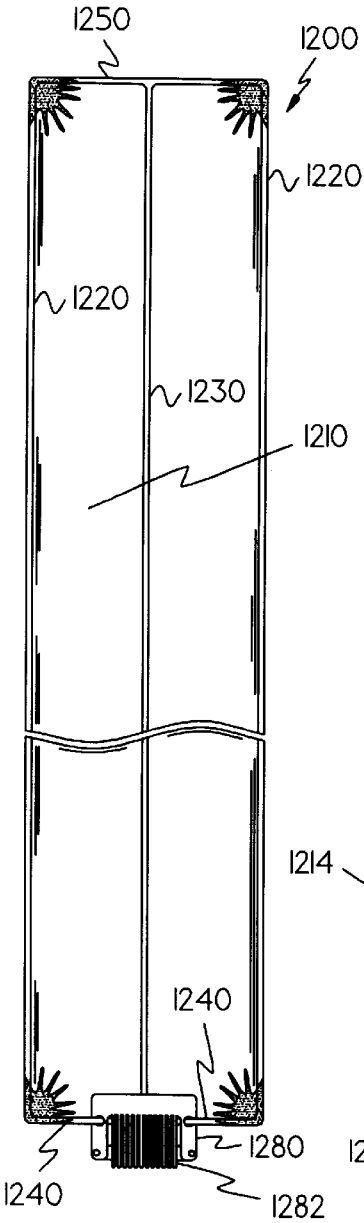
FIG. 12 is a plan view of an alternative embodiment of a curling ribbon of the present invention, incorporating a comb at the base end.
Figure 13:
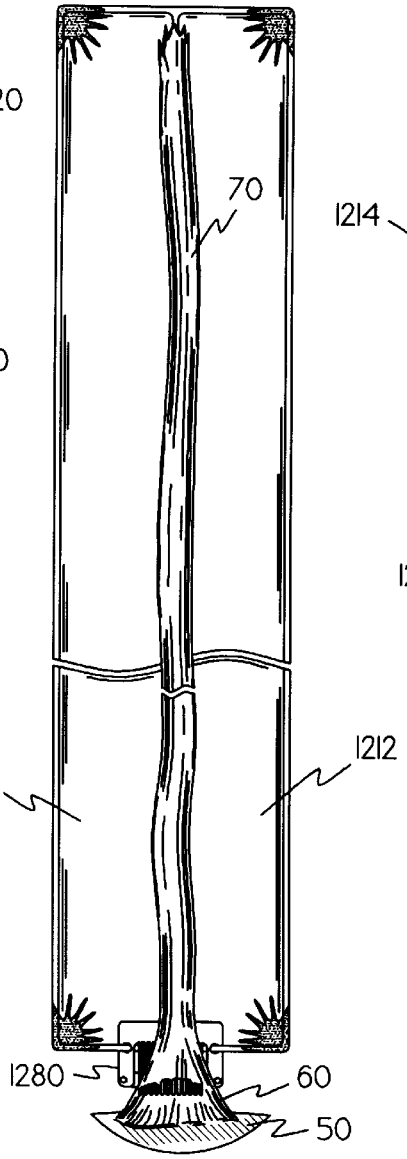
FIG. 13 is a view similar to FIG. 4 of a strand of hair having the curling ribbon of FIG. 12 adjacent thereto, with the comb extending into the base of the hair strand.

FIGS. 12 to 15 illustrate an alternative embodiment of curling ribbon 1200. At the base end of the curling ribbon 1200 is a locking comb 1280, of stiff but somewhat flexible metal, such as stainless steel. Such locking combs are generally available from beauty supply houses. The locking comb 1280 has a set of teeth 1282 for engaging the base 60 of the strand of hair 70, as shown in FIG. 13.

Figure 15:
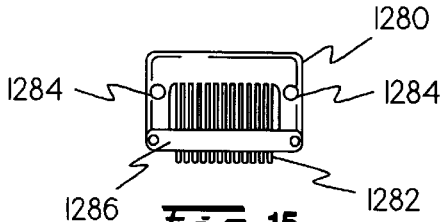
FIG. 15 is a view of the back of the comb incorporated into the curling ribbon shown in FIGS. 12 to 14.

As shown in FIG. 15, the back view of the locking comb 1280, a locking bar 1286 extends horizontally across the comb near the distal end of the teeth 1282. In use, the locking comb 1280 may be snapped between a locked position and an unlocked position.

FIG. 13 shows the curling ribbon 1200 wherein the teeth 1283 engage the subject's hair and the locking comb 1280 has been snapped into the locked position, thereby securing the curling ribbon 1200 to the strand of hair 70.

Figure 8:
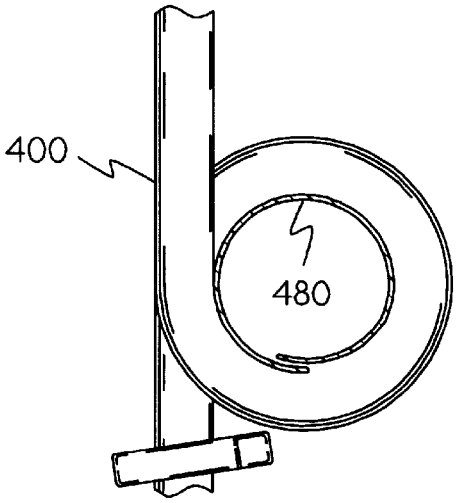
FIG. 8 is a sectional view of FIG. 7 taken along the line 8—8.
Figure 14:
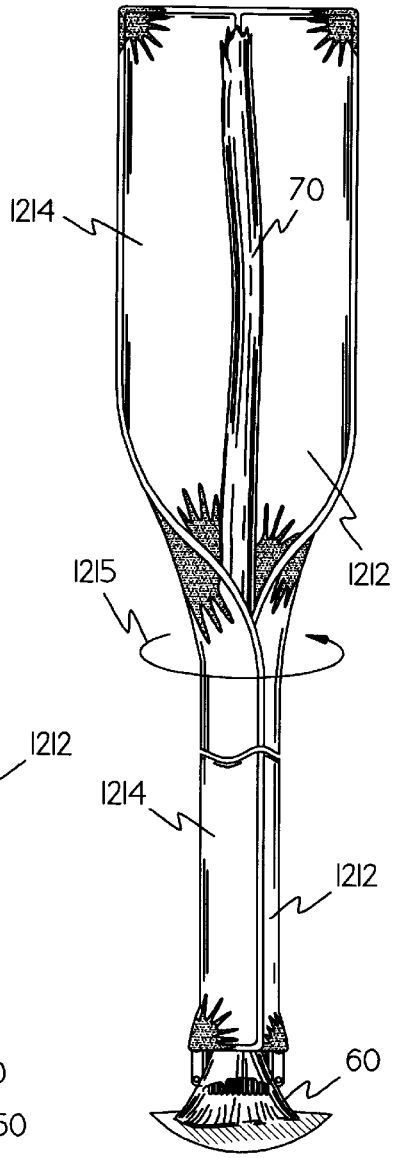
FIG. 14 is a view similar to FIG. 5 of the subject matter of FIG. 13, wherein the curling ribbon partially enwraps the strand of hair.

As shown in FIG. 14, a lower portion of the right hand side 1212 of the curling ribbon 1200 is first folded over the strand 70, and then the left hand side 1214 is folded over the right hand side 1212 in the direction of arrow 1215 so as to envelop the strand 70 inside the curling ribbon 1200. The curling ribbon 1200 is then wound around a curling mandrel, and the mandrel is withdrawn in the same way as illustrated in FIGS. 7 through 9 with respect to curling ribbon 400. When the ribbon 1200 is unwrapped from the curled hair, you use your fingers to unsnap the locking comb 1280 to release the hair strand 70, which unsecures the curling ribbon 1200 from the hair.

As shown in FIG. 12, the locking comb 1280 may be attached to the curling ribbon 1200 by base stiffener 1240 of wire extending through holes 1284. Alternatively, the locking comb 1280 may be attached to the curling ribbon 1200 by sewing it through holes 1284 to the fabric 1210, and in that event the base stiffener 1240 may optionally be omitted. In either event the end stiffener 1250 may optionally be omitted from the curling ribbon when a locking comb 1280 is used.

Modifications to the embodiments described above may be made without departing from the basic spirit of the present invention. Accordingly, it will be appreciated by those skilled in the art that, within the scope of the appended claims, the invention may be practiced other than has been specifically described herein.

I claim:

1. A method for curling hair comprising the following steps:

Isolating a strand of hair that the subject desires to be curled;

Providing a curling ribbon comprising a ribbon of fabric having a plurality of bendable stiffening elements extending longitudinally thereof;

Placing the curling ribbon adjacent the strand of hair and wrapping it around the strand to envelop substantially the entire hair strand;

Securing the curling ribbon to hair at or near the base of the strand;

Providing a curling mandrel of generally cylindrical shape having a diameter the size of the desired curls, and placing it adjacent the base of the hair strand to which the curling ribbon has been secured;

Wrapping the curling ribbon helically around the curling mandrel until substantially the entire strand of hair is coiled around the curling mandrel within the curling ribbon;

Withdrawing the curling mandrel axially from within the coil without uncoiling; the strand;

Applying a curling agent to the strand; and

Permitting the strand to remain coiled within the curling ribbon until the curling agent has curled the strand of hair.

2. The method of claim 1, wherein the curling agent is a setting composition.

3. The method of claim 2, wherein the setting composition is applied to the strand before the curling ribbon is wrapped around the strand.

4. The method of claim 1, wherein the curling agent is a permanent waving composition.

5. The method of claim 4, wherein the setting composition is applied to the strand after the curling mandrel has been withdrawn.

6. The method of claim 1, wherein the curling ribbon is secured to the strand of hair by a spring-loaded clip.

7. The method of claim 1, wherein the curling ribbon further comprises a comb at its base end and the curling ribbon is secured to the strand of hair by said comb.

8. The method of claim 7, wherein said comb is a locking comb of flexible metal.

9. The method of claim 1, further comprising the step of:

Removing the curling ribbon from around the strand and unsecuring it from the strand, so that the curled hair strand may be combed out.

10. The method of claim 1, further comprising the steps of:

Isolating additional strands of hair on the subject's head;

Providing an additional curling ribbon for applying to each of said additional strands of hair;

Placing one the additional curling ribbons adjacent each of the additional strands of hair and wrapping it around the strand to envelop substantially the entire hair strand;

Securing the additional curling ribbon to hair at or near the base of the strand;

Placing said curling mandrel adjacent the base of each of the additional hair strands to which one of the additional curling ribbons has been secured;

Wrapping the curling ribbon helically around the curling mandrel until substantially the entire strand of hair is coiled around the curling mandrel within the curling ribbon;

Withdrawing the curling mandrel axially from within the coil without uncoiling; the strand;

Applying a curling agent to the strand; and

Permitting each of the additional strands of hair to remain coiled within each of the additional curling ribbons until the curling agent has curled the strands of hair.

11. A curling ribbon adapted for use in the method of claim 1, comprising A ribbon of fabric having a base end and a distal end;

A pair of edge stiffeners extending longitudinally along each edge; and

A longitudinal stiffener extending parallel to said edge stiffeners between them.

12. The curling ribbon of claim 11, further comprising a comb secured to the base end of said ribbon of fabric.

13. The curling ribbon of claim 11, further comprising a base stiffener.

14. The curling ribbon of claim 11, further comprising a comb secured to the base stiffener.

15. The curling ribbon of claim 11, further comprising an end stiffener.

16. The curling ribbon of claim 11, wherein said ribbon of fabric is between about 5 and 7 centimeters wide.

17. The curling ribbon of claim 11, wherein said ribbon of fabric is between about 40 and 75 centimeters long.

18. The curling ribbon of claim 11, wherein said ribbon of fabric is brightly colored.

19. The curling ribbon of claim 11, wherein said ribbon of fabric bears a decorative design.

20. A kit for use in performing the method of claim 1, comprising at least 20 curling ribbons, a first curling mandrel, and instructions.

21. The kit of claim 20, further comprising at least one additional curling mandrel having a different diameter from said first curling mandrel.

22. The kit of claim 20, further comprising a curling agent.

* * * * *